US008814635B2

(12) United States Patent
Hosokai et al.

(10) Patent No.: US 8,814,635 B2
(45) Date of Patent: Aug. 26, 2014

(54) SUBSTRATE POLISHING METHOD AND DEVICE

(75) Inventors: Nobukazu Hosokai, Nagaoka (JP); Isamu Oguro, Nagaoka (JP); Jun Watanabe, Tokyo (JP); Tetsujiro Tada, Tokyo (JP)

(73) Assignees: Sanshin Co., Ltd., Nagaoka-Shi (JP); Nihon Micro Coating Co., Ltd., Tokyo (JP)

( * ) Notice: Subject to any disclaimer, the term of this patent is extended or adjusted under 35 U.S.C. 154(b) by 814 days.

(21) Appl. No.: 13/015,016

(22) Filed: Jan. 27, 2011

(65) Prior Publication Data

US 2012/0045968 A1 Feb. 23, 2012

(30) Foreign Application Priority Data

Aug. 19, 2010 (JP) ..... 2010-184018

(51) Int. Cl.
*B24B 21/02* (2006.01)

(52) U.S. Cl.
USPC ..... 451/303; 451/59; 451/61; 451/44; 451/307

(58) Field of Classification Search
USPC ..... 451/41, 44, 51, 59, 61, 103, 108, 168, 451/299, 303, 304, 307, 311
See application file for complete search history.

(56) References Cited

U.S. PATENT DOCUMENTS

| | | | | |
|---|---|---|---|---|
| 6,280,294 | B1 | 8/2001 | Miyamoto | |
| 6,641,465 | B2 | 11/2003 | Miyamoto | |
| 7,070,481 | B1 | 7/2006 | Miyamoto | |
| 7,438,630 | B2 | 10/2008 | Miyamoto | |
| 7,494,401 | B2 | 2/2009 | Miyamoto | |
| 7,690,969 | B2 | 4/2010 | Miyamoto | |
| 7,744,445 | B2 * | 6/2010 | Kubota et al. | 451/41 |
| 8,047,896 | B2 * | 11/2011 | Takahashi et al. | 451/6 |
| 2009/0142992 | A1 * | 6/2009 | Takahashi et al. | 451/9 |
| 2009/0227189 | A1 * | 9/2009 | Maeda et al. | 451/303 |
| 2009/0325465 | A1 * | 12/2009 | Takahashi et al. | 451/6 |
| 2010/0112902 | A1 * | 5/2010 | Bechtold et al. | 451/6 |
| 2010/0112909 | A1 * | 5/2010 | Yamaguchi et al. | 451/44 |
| 2010/0136886 | A1 * | 6/2010 | Hongo et al. | 451/6 |
| 2010/0184362 | A1 | 7/2010 | Miyamoto | |
| 2011/0237164 | A1 * | 9/2011 | Seki et al. | 451/44 |
| 2012/0208437 | A1 * | 8/2012 | Takahashi et al. | 451/8 |

FOREIGN PATENT DOCUMENTS

| | | |
|---|---|---|
| JP | A-11-221742 | 8/1999 |

* cited by examiner

*Primary Examiner* — Eileen P. Morgan
(74) *Attorney, Agent, or Firm* — Oliff PLC

(57) ABSTRACT

A substrate polishing method includes starting to rotate a circular substrate and polishing an inner peripheral edge surface of a center circular hole formed in the circular substrate into a chamfered or rounded surface by pressing the inner peripheral edge surface against a bypass polishing part of a polishing tape that is conveyed intermittently or continuously and by oscillating the bypass polishing part of the polishing tape about a direction perpendicular to a direction that the center circular hole penetrates through the circular substrate. The polishing tape is guided so as to have an advancing portion advancing toward the circular substrate, a returning portion returning from the circular substrate, and a turning-back portion between the advancing portion and the returning portion guided along a side bypass. The bypass polishing part of the polishing tape is the turning-back portion of the polishing tape.

5 Claims, 11 Drawing Sheets

SUBSTRATE POLISHING METHOD AND DEVICE

CROSS REFERENCE TO RELATED APPLICATION

This application claims priority from Japanese Patent Application No. 2010-184018 filed Aug. 19, 2010. The entire content of this priority application is incorporated herein by reference.

TECHNICAL FIELD

The present invention relates to a substrate polishing device for polishing an inner peripheral edge surface of a circular substrate, such as a glass or aluminum substrate for a magnetic recording medium used as a hard disk platter and a substrate for optical recording media including a Compact Disc (CD), Digital Video Disc (DVD), and Blu-ray Disc (BD).

BACKGROUND

In this specification, the term "circular substrate" refers to a substrate having a diameter of 2.5 inches, 1.8 inches, 1.0 inches, or 0.85 inches, for example. Of these sizes, substrates with a 2.5-inch diameter have an outer diameter of 65 mm, an inner circular hole diameter of 20 mm, and a thickness of 0.635 mm; substrates with a 1.8-inch diameter have an outer diameter of 48 mm, an inner circular hole diameter of 12 mm, and a thickness of 0.508 mm; substrates with a 1.0-inch diameter have an outer diameter of 27.4 mm, an inner circular hole diameter of 7 mm, and a thickness of 0.381 mm; and substrates with a 0.85-inch diameter have an outer diameter of 21.6 mm, an inner circular hole diameter of 6 mm, and a thickness of 0.381 mm.

A conventional method for polishing the inner peripheral edge surface of the circular hole formed in this type of circular substrate involves rotating a polishing brush or a polishing pad in contact with the inner peripheral edge surface while supplying an abrasive liquid containing free abrasive grains thereto.

SUMMARY

However, a disadvantage of the conventional polishing method described above is its inability to satisfy the need for improvements in processing quality. For example, the conventional method does not improve the capacity for removing foreign matter, such as glass or resin particles, adhering to the inner peripheral edge surface of the circular substrate. Further, the conventional method does not sufficiently improve the capacity for mirror-polishing the inner and outer peripheral edge surfaces, including chamfered or rounded portions, to a degree of roughness required in specifications of the circular substrate, which specifications have become more demanding in recent years due to the recent trend toward thinner circular substrates with increased recording density, as well as improvements in rotational speed.

In view of the foregoing, it is an object of the invention to solve the above-described problems.

In order to attain the above and other objects, the invention provides a substrate polishing method for polishing a circular substrate formed with a circular center hole that penetrates through the circular substrate in a first direction. The substrate polishing method includes starting to rotate the circular substrate and polishing an inner peripheral edge surface of the center circular hole formed in the circular substrate into one of a chamfered surface and a rounded surface by pressing the inner peripheral edge surface against a bypass polishing part of a polishing tape that is conveyed intermittently or continuously and by oscillating intermittently or continuously the bypass polishing part of the polishing tape about a second direction perpendicular to the first direction. The polishing tape is guided so as to have an advancing portion advancing toward the circular substrate, a returning portion returning from the circular substrate, and a turning-back portion between the advancing portion and the returning portion guided along a side bypass. The bypass polishing part of the polishing tape is the turning-back portion of the polishing tape.

According to another aspect, the present invention provides a substrate polishing device including a rotary mechanism that holds and rotates a circular substrate formed with a circular center hole that penetrates through the circular substrate in a first direction and a polishing mechanism that polishes at least an inner peripheral edge surface of the center circular hole formed in the circular substrate into one of a chamfered surface and a rounded surface with a polishing tape. The polishing mechanism includes a tape-conveying mechanism, a tape-polishing mechanism, a pressure contact mechanism, and a polishing-part-oscillating mechanism. The tape-conveying mechanism intermittently or continuously conveys the polishing tape. The tape-polishing mechanism has an advancing guide part for guiding an advancing portion of the polishing tape toward the circular substrate, a returning guide part for guiding a returning portion of the polishing tape from the circular substrate, and a bypass guide part for guiding a turning-back portion of the polishing tape between the advancing portion and the returning portion along a side bypass. The turning-back portion of the polishing tape serves as a bypass polishing part. The pressure contact mechanism presses the inner peripheral edge surface against the bypass polishing part of the polishing tape by moving the bypass polishing part relative to the circular substrate. The polishing-part-oscillating mechanism intermittently or continuously oscillates the bypass polishing part about a second direction perpendicular to the first direction.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
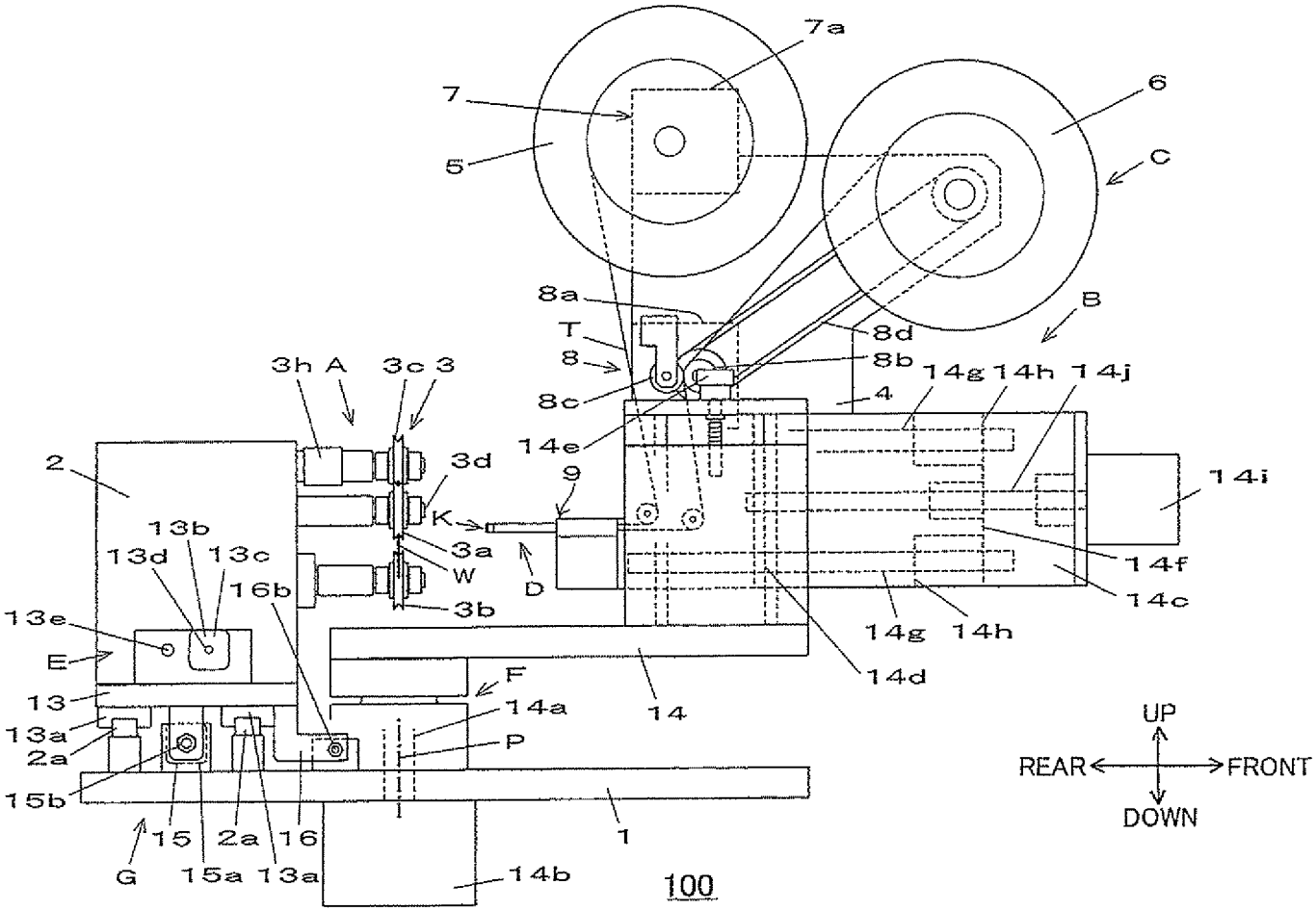
FIG. 1 is a left side view of a substrate polishing device according to an embodiment of the invention.

A substrate polishing device 100 according to an embodiment of the invention will be described while referring to the accompanying drawings wherein like parts and components are designated by the same reference numerals to avoid duplicating description.

The terms "upward," "downward," "upper," "lower," "above," "right," "left," "front," "rear" and the like will be used throughout the description assuming that the substrate polishing device 100 is disposed in an orientation in which it is intended to be used. In use, the substrate polishing device 100 is disposed as shown in FIG. 1.

Figure 3:
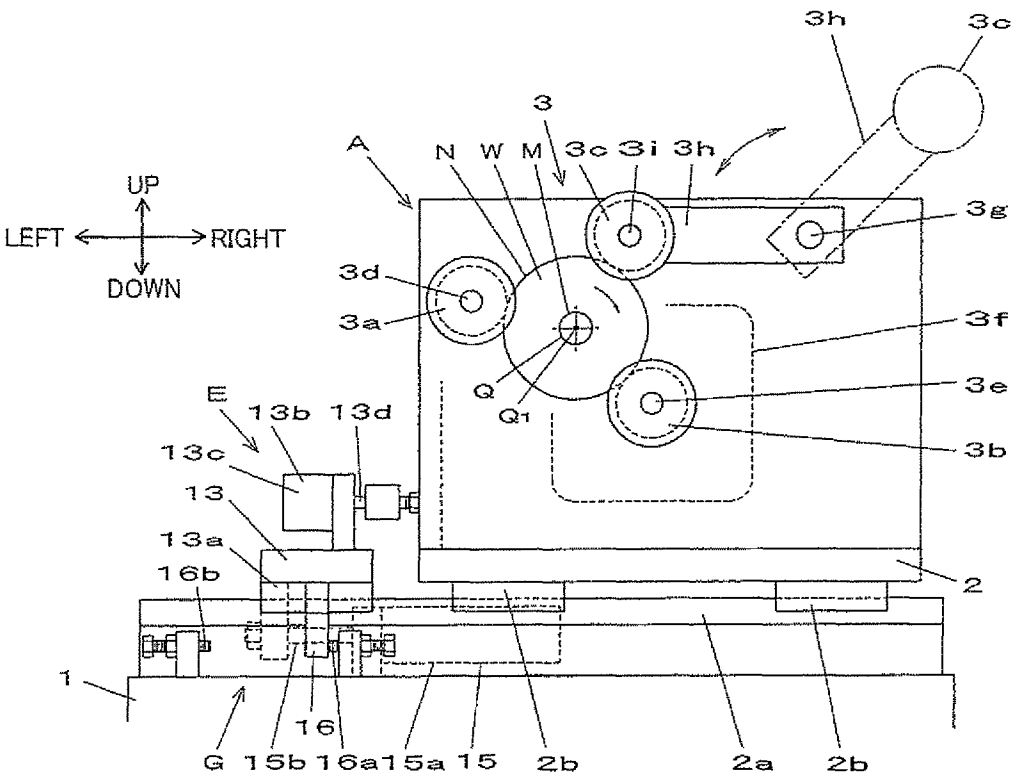
FIG. 3 is a partial front view of the substrate polishing device of FIG. 1.

The substrate polishing device 100 is for polishing a circular glass substrate as a workpiece W shown in FIG. 1. More specifically, as shown in FIG. 3, the workpiece W is formed with a center hole Q, and the substrate polishing device 100 polishes an inner peripheral edge surface M in the center hole Q and an outer peripheral edge surface N of the workpiece W into chamfered or rounded surfaces. The center hole Q is a circular hole penetrating through the workpiece W in a front-rear direction.

As shown in FIG. 1, the substrate polishing device 100 includes a rotary mechanism A, a polishing mechanism B, and a switching mechanism G. The rotary mechanism A holds and rotates the workpiece W. The polishing mechanism B polishes the inner and outer peripheral edge surfaces M and N of the workpiece W. The switching mechanism G moves the rotary mechanism A between an inside contact position and an outside contact position as will be described later.

As shown in FIGS. 1 and 3, the rotary mechanism A includes a base 1 and a laterally reciprocating carriage 2 disposed on top of the base 1. The laterally reciprocating carriage 2 is capable of sliding left and right on top of the base 1 via guide parts 2*a* and sliding parts 2*b*.

A set of rolls 3 is provided on the laterally reciprocating carriage 2 for holding the workpiece W by the outer peripheral edge surface N thereof. The set of rolls 3 includes a fixed roll 3*a*, a driving roll 3*b*, and a pressing roll 3*e*. The fixed roll 3*a* is supported on an idler shaft 3*d* that is linked to the laterally reciprocating carriage 2 so as to be capable of rotating idly. The driving roll 3*b* is supported on a drive shaft 3*e* of a rotary motor 3*f* provided in the laterally reciprocating carriage 2 and is driven to rotate by the rotary motor 3*f*. The pressing roll 3*c* is supported on an idler shaft 3*i*. The idler shaft 3*i* is provided on a support arm 3*h* capable of swinging about a support shaft 3*g* to retract the pressing roll 3*c* from the workpiece W.

With this construction, the workpiece W is supplied to the fixed roll 3*a* and the driving roll 3*b*, either manually or by a feed-delivery mechanism (not shown), and is supported on the fixed roll 3*a* and the driving roll 3*b*. Next, the support arm 3*h* is swung from a position indicated by a chain line in FIG. 3 to a position indicated by a solid line until the pressing roll 3*c* contacts the outer peripheral edge surface N of the workpiece W. At this time, the workpiece W is held at three points by the set of rolls 3 configured of the fixed roll 3*a*, the driving roll 3*b*, and the pressing roll 3*c*. In this state, the rotary motor 3*f* is driven to rotate the driving roll 3*b* so that the workpiece W spins about a central axis $Q_1$ of the center hole Q.

As shown in FIG. 1, the polishing mechanism B includes a tape-conveying mechanism C, a tape-polishing mechanism D, a pressure contact mechanism E, and a polishing-part-oscillating mechanism F.

Figure 2:
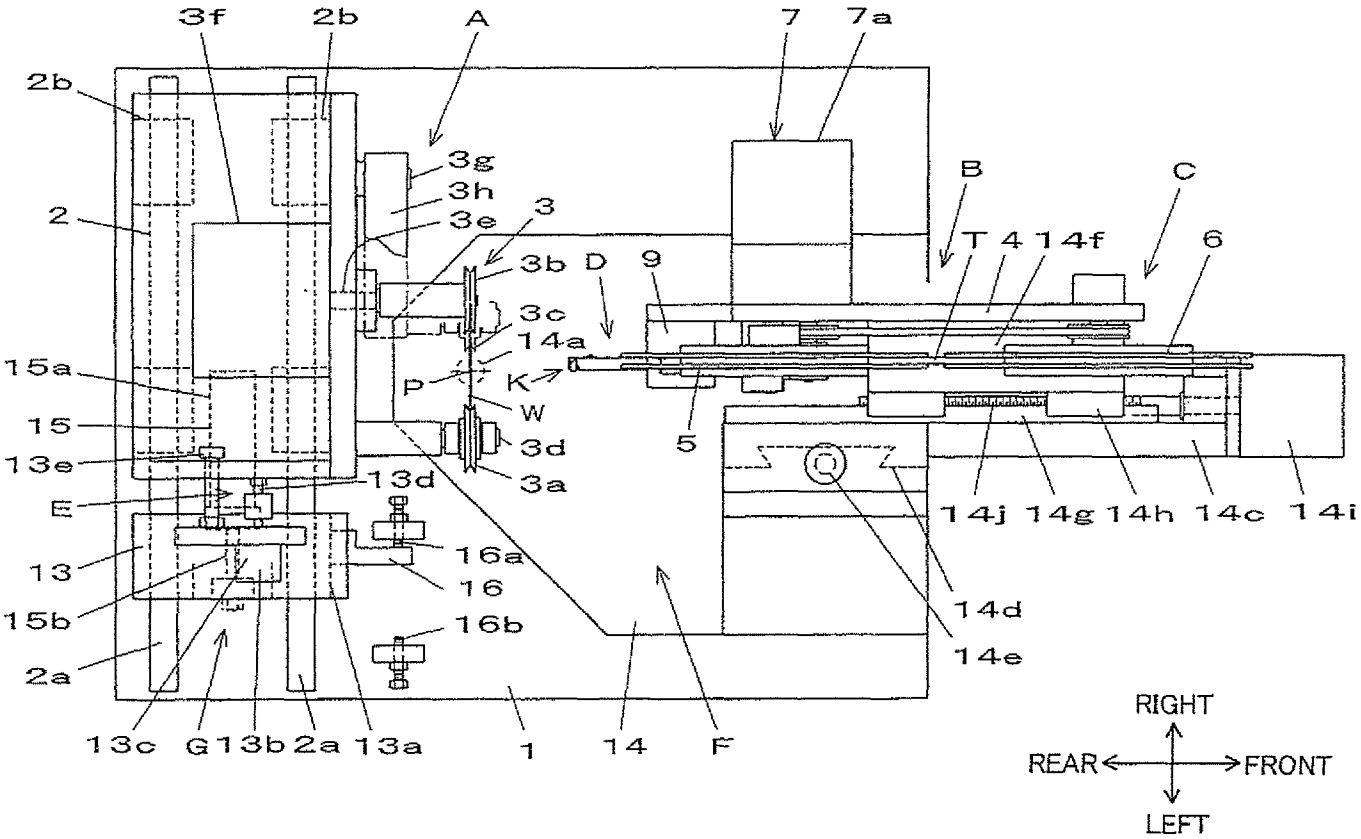
FIG. 2 is a plan view of the substrate polishing device of FIG. 1.

The tape-conveying mechanism C is for conveying a polishing tape T intermittently or continuously. More specifically, as shown in FIGS. 1 and 2, the tape-conveying mechanism C includes a tape support frame 4, a feed reel 5, a take-up reel 6, a back tension mechanism 7, and a feeding mechanism 8.

The tape support frame 4 is disposed above the base 1. The feed reel 5 and the take-up reel 6 are rotatably provided on the tape support frame 4. The back tension mechanism 7 has a tension control motor 7*a* for controlling rotation of the feed reel 5 to maintain tension in the polishing tape T wound about the feed reel 5. The feeding mechanism 8 includes a feed motor 8*a*, a feed roll 8*b*, a pinch roll 8*c*, and a belt mechanism 8*d*.

While the tension control motor 7*a* maintains tension in the polishing tape T wound about the feed reel 5, the feed motor 8*a* drives the feed roll 8*b* to rotate, thereby controlling the feed roll 8*b* and the pinch roll 8*c* contacting the feed roll 8*h* to convey the polishing tape T intermittently or continuously from the feed reel 5 to the take-up reel 6 via the tape-polishing mechanism D. The feed motor 8*a* also rotates the take-up reel 6 indirectly via the belt mechanism 8*d*, controlling the take-up reel 6 to take up the polishing tape T conveyed thereto.

The polishing tape T may be configured of a substrate formed of polyester film, thin metal, cloth, foamed film, flocked fabric, or the like and an abrasive having a prescribed grain size, such as aluminum oxide, chromium oxide, silicon carbide, or diamond, applied or bonded to the substrate.

Some tape polishing devices have a dry polishing system that employs a polishing tape having abrasive grains fixed to the substrate and that uses no lubricant. Other devices have a wet polishing system that employs a polishing tape with abrasive grains fixed to the substrate and polishes while supplying lubricant to the polishing tape. Still other devices have a wet polishing system employing a polishing tape configured of woven or nonwoven cloth, a foamed film, or a flocked fabric with no fixed abrasive grains and supply a polishing liquid containing free abrasive grains to the polishing tape. Of these, the polishing tape T in the preferred embodiment may be either a polishing tape with fixed abrasive grains or a polishing tape with no fixed abrasive grains.

Figure 7:
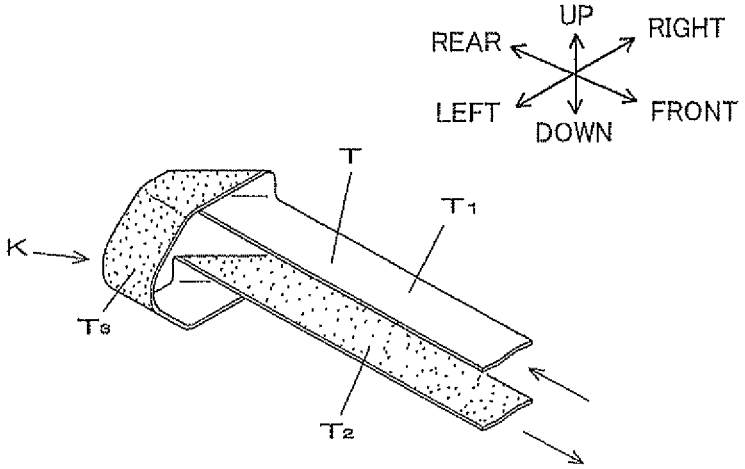
FIG. 7 is a partial perspective view of the polishing tape of FIG. 6, from a point diagonally upward and frontward.
Figure 8:
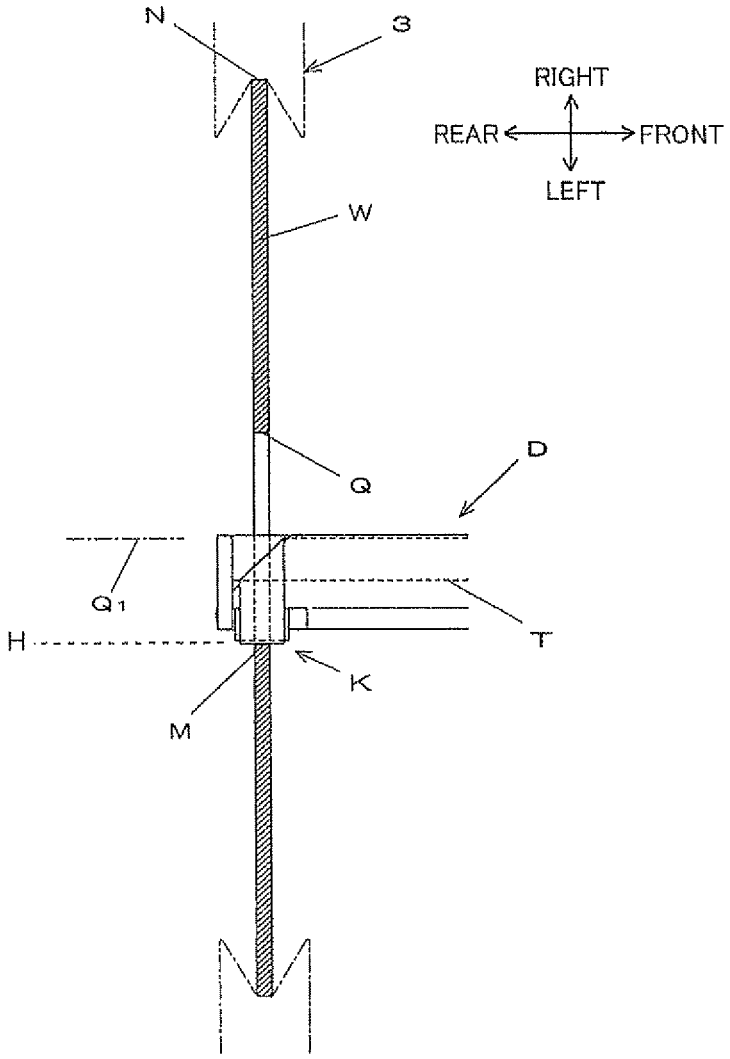
FIG. 8 is a partial cross-sectional top view illustrating polishing of an inner peripheral edge surface of a workpiece.

The tape-polishing mechanism D is for guiding the polishing tape T such that the polishing tape T has, as shown in FIGS. 7 and 8, an advancing portion $T_1$ guided toward the workpiece W, a returning portion $T_2$ guided to return from the workpiece W, and a side bypass portion $T_3$ between the advancing portion $T_1$ and the returning portion $T_2$ guided along a side bypass.

Figure 4:
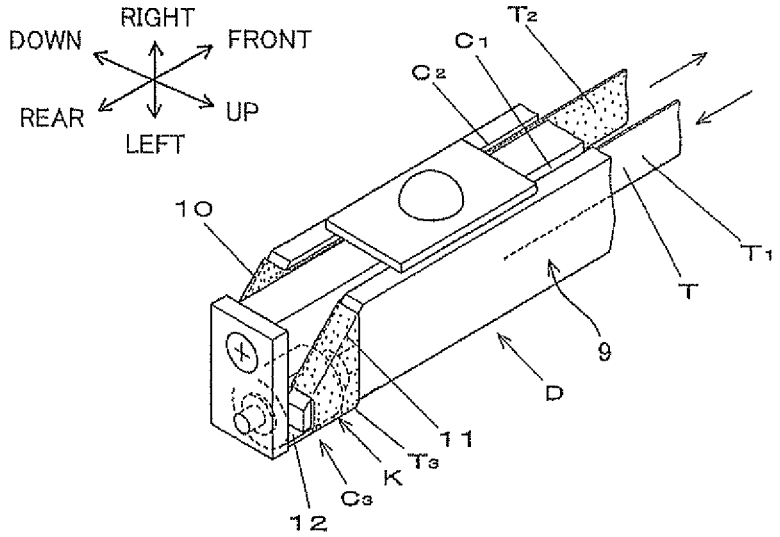
FIG. 4 is a partial perspective view of a tape-polishing mechanism of the substrate polishing device, front a point diagonally rightward and upward.
Figure 5:
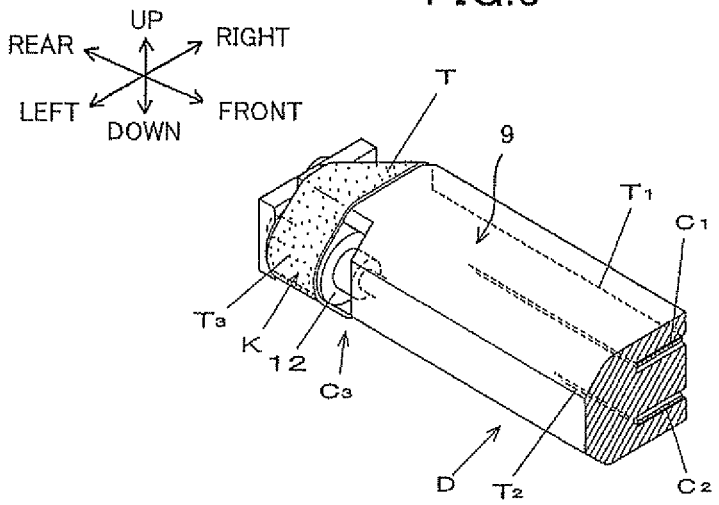
FIG. 5 is a partial perspective view of the tape-polishing mechanism of FIG. 4, from a point diagonally upward and frontward.
Figure 6:
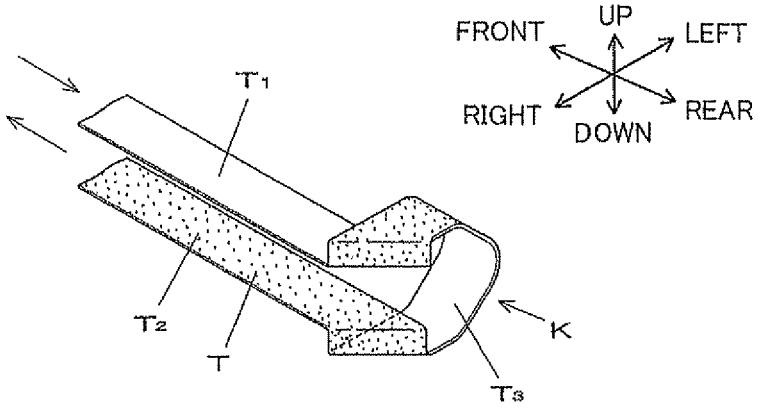
FIG. 6 is a partial perspective view of a polishing tape guided by the tape-polishing mechanism of FIG. 4, from a point diagonally upward and rearward.

More specifically, the tape-polishing mechanism D includes a mount 9 attached to the tape support frame 4. As shown in FIGS. 4 and 5, the mount 9 has formed therein a groove-like advancing guide part $C_1$ for guiding the advancing portion $T_1$ of the polishing tape T in an advancing direction, a groove-like returning guide part $C_2$ for guiding the returning portion $T_2$ of the polishing tape T in a returning direction, and a square pillar-shaped bypass guide part $C_3$ for guiding the side bypass portion $T_3$ (a turning-back portion) of the polishing tape T along the side bypass. The side bypass portion $T_3$ of the polishing tape T serves as a bypass polishing part K for polishing the inner and outer peripheral edge surfaces M and N of the workpiece W.

The bypass guide part $C_3$ is provided with first and second turn-back surface parts 10 and 11, and a pressure-receiving surface part 12. The first turn-back surface part 10 is provide at the lower side of the mount 9 as a 45-degree cutout for guiding the polishing tape T from the advancing guide part $C_1$ to the upper side of the mount 9, and the second turn-back surface part 11 is provide at the upper side of the mount 9 as a 45-degree cutout for guiding the polishing tape T that has passed from the upper side to the lower side of the mount 9 through the side bypass portion $T_3$ into the returning guide part $C_2$. The pressure-receiving surface part 12 is configured of an idler roll and functions to guide the polishing tape T along the side bypass between the turn-back surface parts 10 and 11 and to absorb pressure during polishing.

In this embodiment, the pressure-receiving surface part 12 is formed of an elastic material or a hard material, such as rubber or synthetic resin. When formed of an elastic material, the pressure-receiving surface part 12 can absorb excess pressure during polishing.

The pressure contact mechanism E is for moving the workpiece W with respect to the polishing tape T. Specifically, as shown in FIGS. 2 and 3, the pressure contact mechanism E includes a pressure contact base 13, sliding parts 13*a*, a pressure contact cylinder 13*b*, and a stopper bolt 13*e*. Through the sliding parts 13*a*, the pressure contact base 13 is slidably disposed on the guide parts 2*a* used for slidably guiding the laterally reciprocating carriage 2. The pressure contact cylinder 13*b* has a cylinder part 13*c* and a cylinder rod 13*d*. The cylinder part 13*c* is mounted on the pressure contact base 13. The cylinder rod 13*d* is linked to the laterally reciprocating carriage 2. The stopper bolt 13*e* is threaded into the pressure contact base 13 through an upright part of the laterally reciprocating carriage 2 for adjusting a pressure contact position. The head of the stopper bolt 13*e* is configured as a stopper part for adjusting the pressure contact position of the laterally reciprocating carriage 2, enabling the laterally reciprocating carriage 2 to move the workpiece W so that the inner or outer peripheral edge surface M or N of the workpiece W contacts the bypass polishing part K with pressure.

The polishing-part-oscillating mechanism F is for intermittently or continuously oscillating the bypass polishing part K of the polishing tape T. Specifically, as shown in FIGS. 1 and 2, the polishing-part-oscillating mechanism F includes an oscillating base 14, an oscillating motor 14*b*, a vertical adjustment base 14*c*, a front-to-rear moving base 14*f*, a front-to-rear conveying motor 14*i*, and a ball screw mechanism 14*j*. The oscillating base 14 is slidably disposed on the base 1 via a pivot shaft 14*a* extending in the up-down direction. The oscillating motor 14*b* rotates the pivot shaft 14*a* about a central axis P. The vertical adjustment base 14*c* is adjustably provided on the oscillating base 14 so as to be vertically adjustable via a sliding groove part 14*d* and an adjustment bolt 14*e*, The front-to-rear moving base 14*f* is slidably provided on the vertical adjustment base 14*c* via guide parts 14*g* and sliding parts 14*h*. The front-to-rear conveying motor 14*i* and the ball screw mechanism 14*j* are provided on the vertical adjustment base 14*c* for moving the front-to-rear moving base 14*f* forward and rearward. The tape support frame 4 is mounted on the front-to-rear moving base 14*f*.

Figure 10:
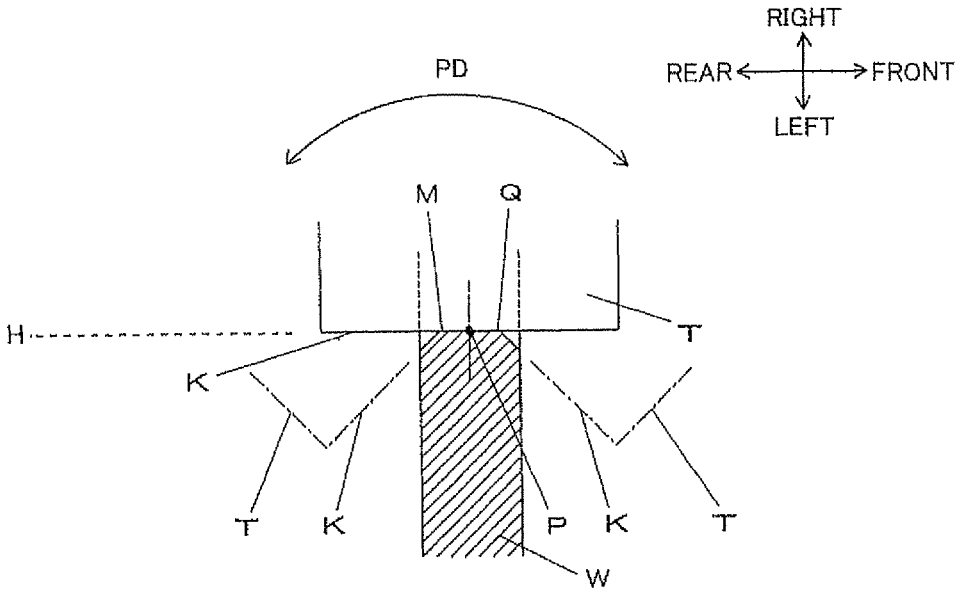
FIG. 10 is a partial cross-sectional top view illustrating polishing of the inner peripheral edge surface into a chamfered surface.
Figure 11:
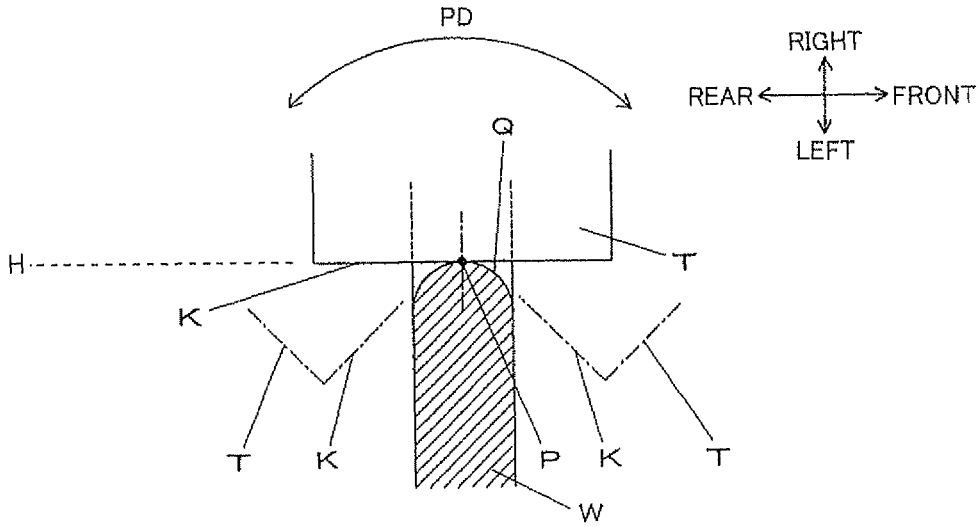
FIG. 11 is a partial cross-sectional top view illustrating polishing of the inner peripheral edge surface into a rounded surface.

With this construction, the bypass polishing part K can be positioned in confrontation with the inner or outer peripheral edge surfaces M or N of the workpiece W by moving the front-to-rear moving base 14*f* in the front-to-rear direction. Further, the bypass polishing part K can be oscillated by oscillating the oscillating base 14 about the central axis P of the pivot shaft 14*a* when the pivot shaft 14*a* is rotated. By oscillating the bypass polishing part K intermittently or continuously in a direction PD shown in FIGS. 10 and 11 about the central axis P, the bypass polishing part K can polish the inner (or outer) peripheral edge surface M (or N) into a chamfered as shown in FIG. 10 or a rounded surface as shown in FIG. 11.

Figure 9:
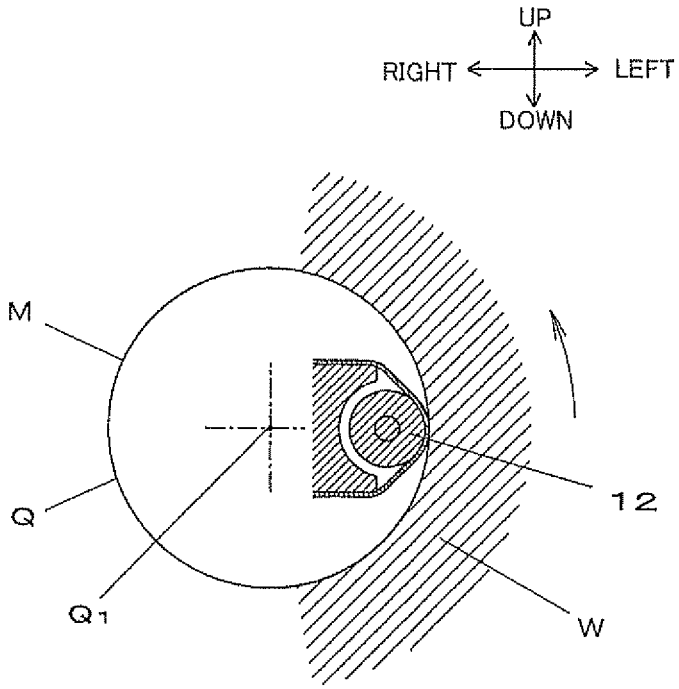
FIG. 9 is a partial cross-sectional rear view illustrating polishing of the inner peripheral edge surface of the workpiece.
Figure 12:
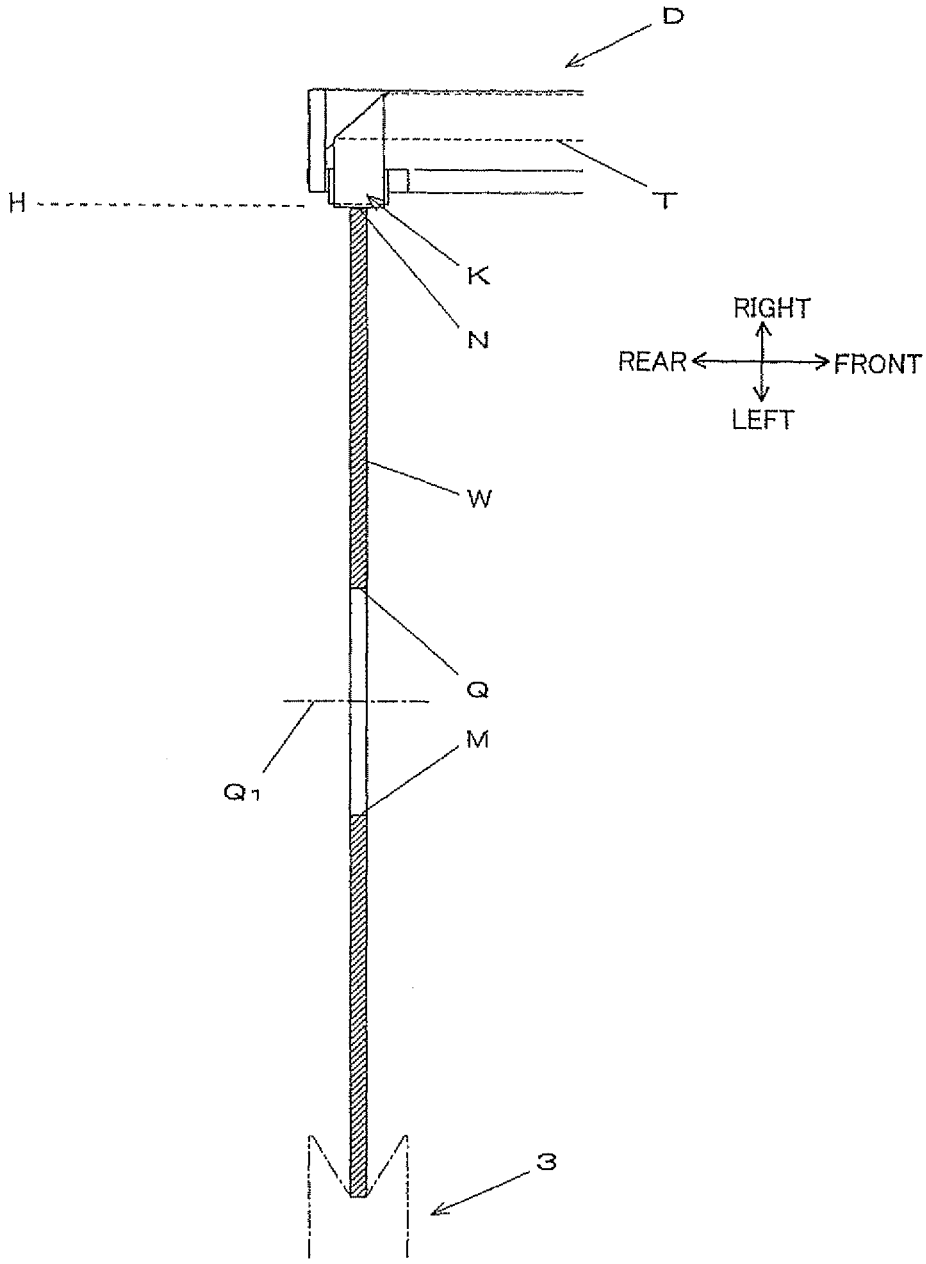
FIG. 12 is a partial cross-sectional top view illustrating polishing of an outer peripheral edge surface of the workpiece.
Figure 13:
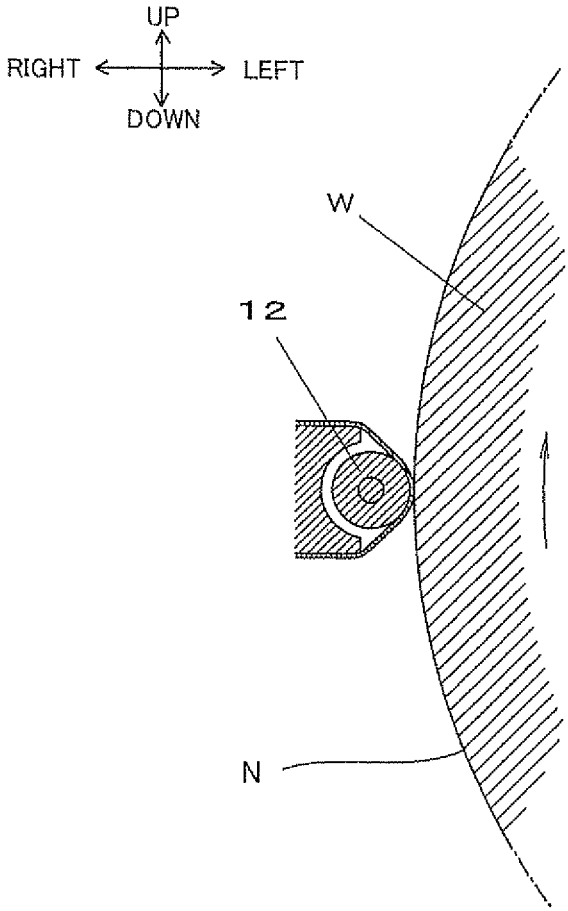
FIG. 13 is a partial cross-sectional rear view illustrating polishing of the outer peripheral edge surface of the workpiece.

As shown in FIGS. 2 and 3, the switching mechanism G includes a switching cylinder 15. The switching cylinder 15 has a cylinder part 15*a* provided on the base 1, and a cylinder rod 15*b* linked to the pressure contact base 13. The switching mechanism G also includes a restricting member 16 provided on the pressure contact base 13 and a pair of restricting bolts 16*a* and 16*b* disposed on the base 1 so as to be adjustable in the right-left direction. The restriction bolts 16*a* and 16*b* restrict the left-right movement of the restricting member 16 so as to position the rotary mechanism A (more specifically, the workpiece W supported by the rotary mechanism A) selectively at an inside contact position and an outside contact position. When the rotary mechanism A (the workpiece W) is at the inside contact position, the inner peripheral edge surface M of the workpiece W supported by the laterally reciprocating carriage 2 can contact the bypass polishing part K with pressure at a contact position H as shown in FIGS. 8 and 9. When the rotary mechanism A (the workpiece W) is at the outside contact position, on the other hand, the outer peripheral edge surface N of the workpiece W supported by the laterally reciprocating carriage 2 can contact the bypass polishing part K with pressure at the contact position H as shown in FIGS. 12 and 13. With this construction, the rotary mechanism A can be switched between the inside contact position and the outside contact position. Thus, both the inner and outer peripheral edge surfaces M and N of the workpiece W can be polished into chamfered or rounded surfaces.

Figure 14:
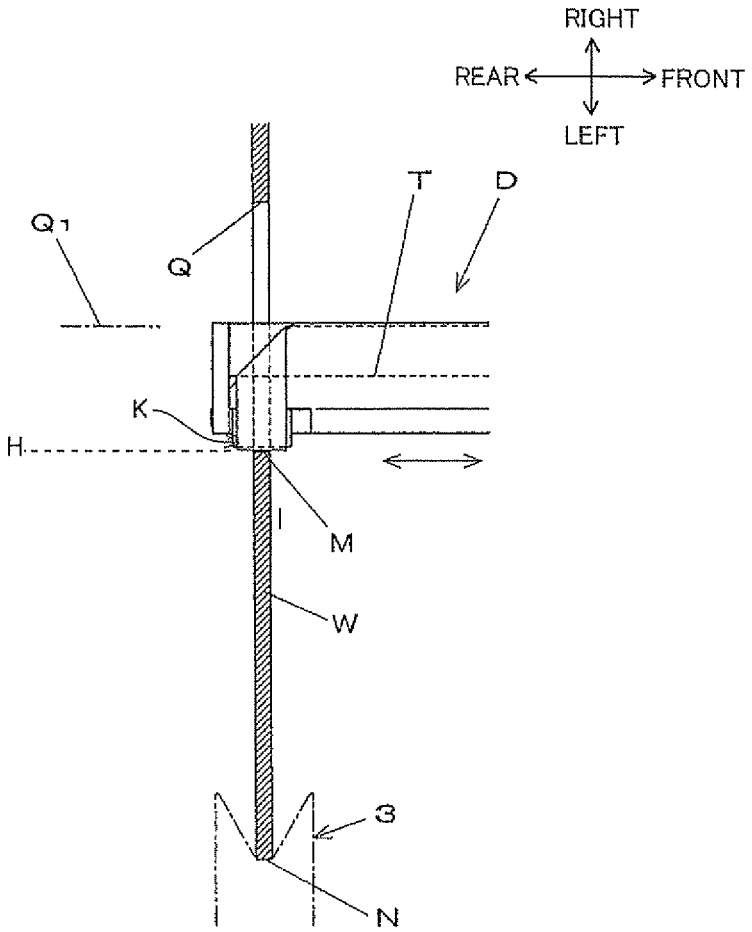
FIG. 14 is a partial cross-sectional top view illustrating polishing of the inner peripheral edge surface of the workpiece.

Although not shown in the drawings, the substrate polishing device 100 also includes an oscillating mechanism for oscillating the tape-polishing mechanism D in the front-rear direction as indicated by arrows in FIG. 14, which direction is orthogonal to the up-down direction that the polishing tape T moves in the bypass polishing part K. This oscillating mechanism may have an eccentric wheel structure that includes an oscillating motor disposed between the front-to-rear moving base 14*f* and the tape support frame 4, an eccentric wheel mounted on the shaft of this oscillating motor, and a cam plate disposed at a position opposing the outer peripheral surface of the eccentric wheel, for example, or any other type of oscillating mechanism capable of oscillating the tape-polishing mechanism D.

With the substrate polishing device 100 having the structure described above, the workpiece W (circular substrate) is supplied to the rotary mechanism A either automatically or through manual operations. The set of rolls 3 in the rotary mechanism A hold the workpiece W by the outer peripheral edge surface N, and the rotary motor 3*f* is actuated for starting to rotate the driving roll 3*b* to spin the workpiece W.

In the meantime, while the tape-conveying mechanism C conveys the polishing tape T either intermittently or continuously, the front-to-rear conveying motor 14*i* of the tape-polishing mechanism D drives the front-to-rear moving base 14*f* to advance until the bypass polishing part K is positioned in opposition to the inner peripheral edge surface M of the workpiece W, as shown in FIGS. 5 and 9.

Further, the pressure contact cylinder 13*b* mounted on the pressure contact base 13 of the pressure contact mechanism E pushes the laterally reciprocating carriage 2 rightward so that the inner peripheral edge surface M of the workpiece W is pressed against the bypass polishing part K.

The oscillating motor 14*b* oscillates the oscillating base 14 of the polishing-part-oscillating mechanism F intermittently or continuously about the central axis P. The oscillating motion of the oscillating base 14 causes the bypass polishing part K to oscillate intermittently or continuously in the direction OD about the central axis P. Through this intermittent or continuous oscillating motion, the bypass polishing part K can polish the inner peripheral edge surface M of the workpiece W into a chamfered surface as shown in FIG. 10 or a rounded surface as shown in FIG. 11.

This construction can improve processing quality, including the capability to remove glass and resin particles and other foreign matter deposited on the inner peripheral edge surface M, and the capacity for mirror-polishing the inner peripheral edge surface M. The substrate polishing device 100 having this structure can also easily polish the inner peripheral edge surface M into a chamfered or rounded surface.

Further, the advancing guide part $C_1$ and the returning guide part $C_2$ guide the polishing tape T along advancing and returning paths, respectively, and the bypass guide part $C_3$ guides the portion of the polishing tape T being turned back from the advancing path to the returning path along the side bypass, whereby the side bypass portion $T_3$ of the polishing tape T guided along the side bypass by the bypass guide part $C_3$ serves as the bypass polishing part K for polishing the inner peripheral edge surface M of the workpiece W.

Accordingly, this structure enables the formation of a small, compact bypass polishing part K that can favorably polish the inner peripheral edge surface M of the workpiece W without interfering with peripheral components, improving flexibility in the processing position and layout design.

As described above, the substrate polishing device 100 is provided with the switching mechanism G for switching the rotary mechanism A between the inside contact position at which the inner peripheral edge surface M opposes the bypass polishing part K at the contact position H and the outside contact position at which the outer peripheral edge surface N opposes the bypass polishing part K at the contact position H in order to enable to polish both the inner and outer peripheral edge surfaces M and N of the workpiece W. Accordingly, the substrate polishing device 100 of this embodiment can also polish the outer peripheral edge surface N of the workpiece W to form a chamfered or rounded surface, as illustrated in FIGS. 12 and 13. Hence, the substrate polishing device 100 can polish both the inner and outer peripheral edge surfaces M and N of the workpiece W, improving operation efficiency.

As described above, by providing the substrate polishing device 100 with the oscillating mechanism for oscillating the tape-polishing mechanism D in the front-rear direction, the oscillating motion of the polishing tape T adds a polishing effect capable of favorably improving the polishing process.

Further, the bypass guide part $C_3$ is provided with the two turn-back surface parts 10 and 11 for guiding the polishing tape T from the advancing guide part $C_1$ onto a side bypass and further to the returning guide part $C_2$; and the pressure-receiving surface part 12 for guiding the polishing tape T along the bypass between the turn-back surface parts 10 and 11 and for absorbing pressure during polishing. Accordingly, the bypass guide part $C_3$ can suitably guide the polishing tape T along the side bypass to ensure smooth conveyance of the polishing tape T.

Further, since the pressure-receiving surface part 12 can be formed of an elastic or hard material, such as rubber or synthetic resin, the pressure-receiving surface part 12 can effectively absorb pressure during polishing.

Further, since the bypass polishing part K of the polishing tape T can be configured to perform wet polishing or dry polishing, the substrate polishing device 100 can support many specifications for the workpiece W, such as type of material and polishing conditions.

While the invention has been described in detail with reference to the embodiment thereof, it would be apparent to those skilled in the art that various changes and modifications may be made therein without departing from the spirit of the invention.

In the embodiment described above, the pressure contact mechanism E has a structure for moving the workpiece W so that the inner or outer peripheral edge surface M or N of the workpiece W is pressed against the bypass polishing part K. However, the pressure contact mechanism E may be alternatively structured to move the bypass polishing part K so that the bypass polishing part K is pressed against the inner or outer peripheral edge surfaces M or N. This modified configuration would also obtain the same operations and effects described in the above-described embodiment.

In the embodiment described above, the switching mechanism G is configured to move the rotary mechanism A in the right-left direction between the inside contact position and the outside contact position. However, the switching mechanism G may be alternatively configured to move at least the tape-polishing mechanism D and the polishing-part-oscillating mechanism F of the polishing mechanism B in the right-left direction between a position at which the bypass polishing part K presses against the inner peripheral edge surface M and a position at which the bypass polishing part K presses against the outer peripheral edge surface N.

The structural design of the rotary mechanism A, the polishing mechanism B, the tape-conveying mechanism C, the tape-polishing mechanism D, the pressure contact mechanism E, the polishing-part-oscillating mechanism F, the switching mechanism G, and the like, and the materials and configuration of the polishing tape T and the like may be suitably modified as necessary. Further, the substrate polishing device 100 may employ a dry polishing method or a wet polishing method according to process specifications.

According to the specifications described above, the substrate polishing device 100 of the above-described embodiment can fully achieve the intended objects.

What is claimed is:

1. A substrate polishing device comprising:

a rotary mechanism configured to hold and rotate a circular substrate formed with a circular center hole that penetrates through the circular substrate in a penetration direction; and a polishing mechanism configured to polish at least an inner peripheral edge surface of the center circular hole formed in the circular substrate into either a chamfered surface or a rounded surface with a polishing tape, the polishing mechanism including:

a tape-conveying mechanism configured to intermittently or continuously convey the polishing tape;

a tape-polishing mechanism including (1) a roller, (2) a first groove configured to guide an advancing portion of the polishing tape toward the roller in an advancing direction, (3) a second groove configured to guide a returning portion of the polishing tape from the roller in a returning direction, (4) a first edge that causes the polishing tape to rotate from the advancing direction to a circumferential direction around the roller, and (5) a second edge that causes the polishing tape to rotate from the circumferential direction to the returning direction, the polishing tape moving in the circumferential direction being configured to polish the inner peripheral edge surface of the circular substrate;

a pressure contact mechanism configured to move the circular substrate with regard to the polishing tape to press the inner peripheral edge surface of the circular substrate against the polishing tape moving in the circumferential direction; and a polishing-part-oscillating mechanism configured to intermittently or continuously oscillate the polishing tape in the circumferential direction.

2. The substrate polishing device according to claim 1, further comprising a switching mechanism configured to move the rotary mechanism relative to both the tape-polishing mechanism and the polishing-part-oscillating mechanism so as to switch a position of the rotary mechanism relative to the polishing tape between (i) an inside contact position at which the inner peripheral edge surface of the circular substrate opposes the polishing tape moving in the circumferential direction and (ii) an outside contact position at which an outer peripheral edge surface of the circular substrate opposes the polishing tape moving in the circumferential direction for polishing both the inner peripheral edge surface and the outer peripheral edge surface.

3. The substrate polishing device according to claim 1, wherein the tape-polishing mechanism further includes:

a first surface configured to guide the polishing tape from the first groove to the roller;

a second surface configured to guide the polishing tape from the roller to the second groove; and a pressure-receiving surface configured to guide the polishing tape along the roller and to absorb pressure during polishing.

4. The substrate polishing device according to claim 3, wherein the pressure-receiving surface part is made of a material selected from the group comprising an elastic material and a hard material.

5. The substrate polishing device according to claim 3, wherein the polishing mechanism has either a dry polishing configuration or a wet polishing configuration.

* * * * *